US008749362B2

(12) United States Patent
Lee et al.

(10) Patent No.: US 8,749,362 B2
(45) Date of Patent: Jun. 10, 2014

(54) APPARATUS AND METHOD FOR PROVIDING HAPTIC FUNCTION IN PORTABLE TERMINAL

(75) Inventors: Sang-Kyoung Lee, Suwon-si (KR); Jae-Kwang Han, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 691 days.

(21) Appl. No.: 12/956,320

(22) Filed: Nov. 30, 2010

(65) Prior Publication Data

US 2011/0128134 A1 Jun. 2, 2011

(30) Foreign Application Priority Data

Dec. 1, 2009 (KR) ..... 10-2009-0118088

(51) Int. Cl.
*G08B 6/00* (2006.01)

(52) U.S. Cl.
USPC ..... 340/407.2; 340/407.1

(58) Field of Classification Search
USPC ..... 340/407.1, 407.2
See application file for complete search history.

(56) References Cited

U.S. PATENT DOCUMENTS

| | | | | |
|---|---|---|---|---|
| 7,301,094 | B1 * | 11/2007 | Noro et al. | 84/645 |
| 7,765,333 | B2 * | 7/2010 | Cruz-Hernandez et al. | 710/5 |
| 7,966,034 | B2 * | 6/2011 | Northcutt et al. | 455/550.1 |
| 8,115,091 | B2 * | 2/2012 | Brenner et al. | 84/645 |
| 8,131,321 | B2 * | 3/2012 | Linjama et al. | 455/567 |
| 2002/0025838 | A1 * | 2/2002 | Kawamura | 455/567 |
| 2002/0149561 | A1 * | 10/2002 | Fukumoto et al. | 345/156 |
| 2003/0114150 | A1 * | 6/2003 | Hayashi | 455/418 |
| 2008/0150905 | A1 * | 6/2008 | Grivna et al. | 345/173 |
| 2009/0322498 | A1 * | 12/2009 | Yun et al. | 340/407.2 |
| 2010/0073329 | A1 * | 3/2010 | Raman et al. | 345/177 |
| 2012/0249464 | A1 * | 10/2012 | Cruz-Hernandez et al. | 345/173 |

* cited by examiner

*Primary Examiner* — Eric M Blount
(74) *Attorney, Agent, or Firm* — Jefferson IP Law, LLP

(57) ABSTRACT

An apparatus and method for synchronizing a sound source and a vibration generated according to a user's touch input in order to implement a haptic function in a portable terminal are provided. The apparatus includes a response processor for synchronizing a time when a vibration is generated and a time when a sound source is generated by regulating a time when a vibration request signal is generated.

15 Claims, 4 Drawing Sheets

APPARATUS AND METHOD FOR PROVIDING HAPTIC FUNCTION IN PORTABLE TERMINAL

PRIORITY

This application claims the benefit under 35 U.S.C. §119 (a) of a Korean patent application filed in the Korean Intellectual Property Office on Dec. 1, 2009 and assigned Serial No. 10-2009-0118088, the entire disclosure of which is hereby incorporated by reference.

BACKGROUND OF THE INVENTION

1. Field of the Invention

The present invention relates to an apparatus and method for providing a haptic function which delivers various stimuli to a user according to an application currently being executed. More particularly, the present invention relates to an apparatus and method for synchronizing a sound source and a vibration generated according to a user's touch input in order to implement the haptic function in a portable terminal.

2. Description of the Related Art

With recent technical advances, portable terminals, providing wireless voice calls and data exchanges, have become ubiquitous in modern society. In the past, the portable terminals were regarded as portable devices that only provided wireless calls. However, along with the technological advances and an introduction of the wireless Internet, the portable terminals are now used for many purposes in addition to simple telephone calls or scheduling. For example, the portable terminals now provide a variety of functions, such as games, remote controlling using near field communication, capturing images using a built-in digital camera, and the like, to satisfy users' demands.

Recently introduced portable terminals provide various vibration patterns by using a haptic function, and also provide a function when a vibration bell is generated by using the various vibration patterns.

In conventional computer technology, information is exchanged between a human and a computer by using visual or auditory sense information. However, to satisfy the growing user demand on more specific and realistic information, a haptic technology has been developed to deliver tactile information.

The term 'haptic' is generally used to designate a computer tactile technology, and includes a force feedback which enables a user to feel a force and a sense of motion and a tactile feedback which enables the user to feel a tactile sensation of an object. The haptic technology is used for a game simulator, a medial simulator, and the like. In addition thereto, the haptic technology is widely used in various fields requiring increased cost, time, or risk to be directly experienced by humans.

In general, the haptic technology uses a vibration and a sound source in response to a user's touch input. However, since sound source reproduction and a vibration generation request corresponding to the user's touch input are separately processed, the vibration and the sound source may be generated with a time difference. For example, the vibration is generated after the sound source is generated, rather than the vibration and the sound source being generated simultaneously.

Accordingly, since the sound source and the vibration are generated with a time difference as described above, the user of the portable terminal cannot intuitively use the haptic function.

SUMMARY OF THE INVENTION

An aspect of the present invention is to address at least the above-mentioned problems and/or disadvantages and to provide at least the advantages described below. Accordingly, an aspect of the present invention is to provide an apparatus and method for simultaneously generating a sound source and a vibration when a haptic function is implemented in a portable terminal.

Another aspect of the present invention is to provide an apparatus and method for generating a vibration request signal by synchronizing the signal to sound source reproduction to simultaneously generate a sound source and a vibration in a portable terminal.

In accordance with an aspect of the present invention, an apparatus for providing a haptic function in a portable terminal is provided. The apparatus includes a response processor for synchronizing a time when a vibration is generated and a time when a sound source is generated by regulating a time when a vibration request signal is generated.

In accordance with another aspect of the present invention, a method of providing a haptic function in a portable terminal is provided. The method includes synchronizing a time when a vibration is generated and a time when a sound source is generated by regulating a time when a vibration request signal is generated.

In accordance with another aspect of the present invention, an apparatus for providing a haptic function in a portable terminal is provided. The apparatus includes a sound source processor for calling a sound source function upon generation of a user's touch input and for generating a vibration request signal, a synchronization unit for synchronizing a time when a sound source is reproduced and a time when the vibration request signal is generated, a reproduction period determination unit for determining a period in which the sound source is reproduced, and a vibration processor for driving a vibration motor upon reception of the vibration request signal.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features, and advantages of certain exemplary embodiments of the present invention will be more apparent from the following detailed description taken in conjunction with the accompanying drawings, in which.

Throughout the drawings, like reference numerals will be understood to refer to like parts, components and structures.

DETAILED DESCRIPTION OF EXEMPLARY EMBODIMENTS

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions may be omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention are provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

By the term "substantially" it is meant that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Exemplary embodiments of the present invention provide an apparatus and method for simultaneously generating a sound source and a vibration by generating a vibration request signal in a period of starting sound source reproduction or in a period of ending sound source reproduction in a portable terminal.

In the following descriptions, the portable terminal includes a mobile communication terminal, a Personal Digital Assistant (PDA), a Portable Multimedia Player (PMP), a digital camera, a portable game machine, a Moving Picture Experts Group (MPEG) Audio Layer 3 (MP3) player, and the like. The portable terminal provides various vibration patterns, and also provides a haptic function which generates a vibration bell by using various vibration patterns. The haptic function is a function for providing a tactile feedback (e.g., vibration, touch, heat, and the like) in response to a user's touch input in the portable terminal.

Figure 1:
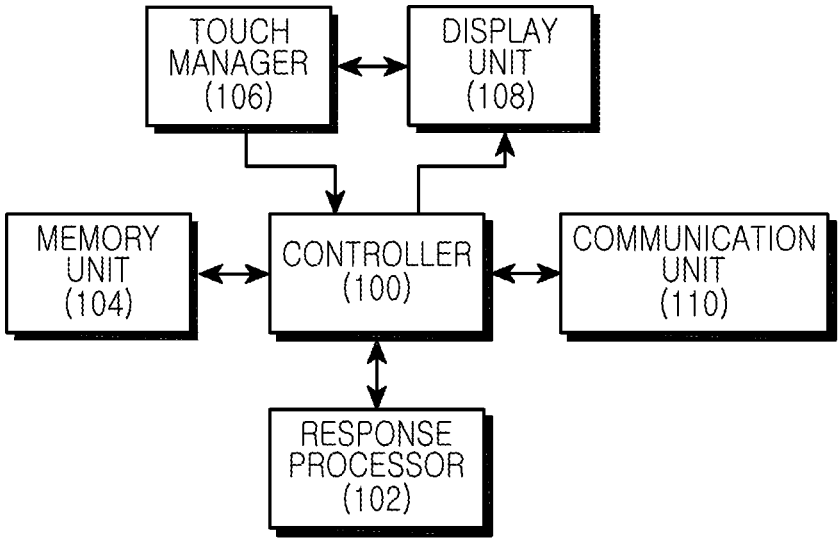
FIG. 1 is a block diagram illustrating a structure of a portable terminal for synchronizing a vibration and a sound source to implement a haptic function according to an exemplary embodiment of the present invention.

FIG. 1 is a block diagram illustrating a structure of a portable terminal for synchronizing a vibration and a sound source to implement a haptic function according to an exemplary embodiment of the present invention.

Referring to FIG. 1, the portable terminal includes a controller 100, a response processor 102, a memory unit 104, a touch manager 106, a display unit 108, and a communication unit 110. The portable terminal may include additional units that are not illustrated or described merely for sake of conciseness. Similarly, the functionality of two or more of the above described units of the portable terminal may be integrated into a single component.

First, the controller 100 provides overall control to the portable terminal For example, the controller 100 processes and controls voice telephony and data communications. In addition to its typical function, the controller 100 synchronizes a sound source and a vibration so that they are simultaneously generated to implement the haptic function upon detection of a users' touch input.

That is, in order to mitigate a case where the sound source and the vibration, which are used to implement the haptic function, are generated with a specific time difference when the touch input is made by the user in the portable terminal of the related art, the controller 100 controls the response processor 102 to simultaneously generate the sound source and the vibration.

Under the control of the controller 100, the response processor 102 generates the sound source and the vibration which are used to implement the haptic function.

In general, upon reception of a vibration request signal and a signal including vibration data, the response processor 102 generates a vibration by driving a vibration motor. Herein, the signals are generated while the sound source is reproduced.

However, when the vibration generation request is received in a period of starting sound source reproduction or in a period of ending sound source reproduction, the response processor 102 simultaneously generates the sound source and the vibration, whereas when the vibration generation request is received in the middle of a period in which the sound source is reproduced, the response processor 102 generates the sound source and the vibration with a specific time difference.

Further, since the response processor 102 separately processes the sound source reproduction and the vibration generation request corresponding to the user's touch input, the response processor 102 may generate the vibration and the sound source with a time difference. For example, the vibration is generated after the sound source is generated, instead of simultaneously generating the vibration and the sound source.

Accordingly, the response processor 102 generates the vibration generation request, which is generated in the middle of the period in which the sound source is reproduced, in the period of starting sound source reproduction or in the period of ending sound source reproduction. Thereafter, the response processor 102 generates the vibration according to a presence/absence of the vibration request signal, so that the vibration generation request is synchronized to the sound source reproduction.

The operation of the response processor 102 will be described in more detail below with reference to FIG. 3 and FIG. 4.

The memory unit 104 includes a Read Only Memory (ROM), a Random Access Memory (RAM), a flash ROM, and the like. The ROM stores a microcode (i.e., code) of a program, by which the controller 100 and the response processor 102 are processed and controlled, and a variety of reference data.

The RAM is a working memory of the controller 100 and stores temporary data that is generated while programs are performed. The flash ROM stores a variety of rewritable data, such as phonebook entries, outgoing messages, and incoming messages.

The touch manager 106 detects the user's touch input and performs an operation depending on the touch input under the instruction of the controller 100. That is, upon generation of the user's touch input, the touch manager 106 provides the controller 100 with information on a position corresponding to a point where the touch input is generated, or the touch manager 106 determines data corresponding to the position and outputs the data to the display unit 108. The touch manager 106 implies a touch screen panel.

The display unit 108 displays information such as state information, which is generated while the portable terminal operates, limited numeric characters, large volumes of moving and still pictures, and the like. The display unit 108 may be a color Liquid Crystal Display (LCD), an Active Mode Organic Light Emitting Diode (AMOLED), and the like. The display unit 108 may include a touch input device as an input device when using a touch input type portable terminal.

The communication unit 110 transmits and receives a Radio Frequency (RF) signal of data that is input and output through an antenna (not illustrated). For example, in a transmitting process, data to be transmitted is subject to a channel-coding process and a spreading process, and then the data is transformed to an RF signal. In a receiving process, the RF signal is received and transformed to a base-band signal, and the base-band signal is subject to a de-spreading process and a channel-decoding process, thereby restoring the data.

Although the function of the response processor 102 may be performed by the controller 100 of the portable terminal, these elements are separately constructed for exemplary purposes only. Thus, it should be understood that various modifications may be made within the scope of the present invention. For example, these elements may be constructed such that their functions are processed by the controller 100.

Figure 2:
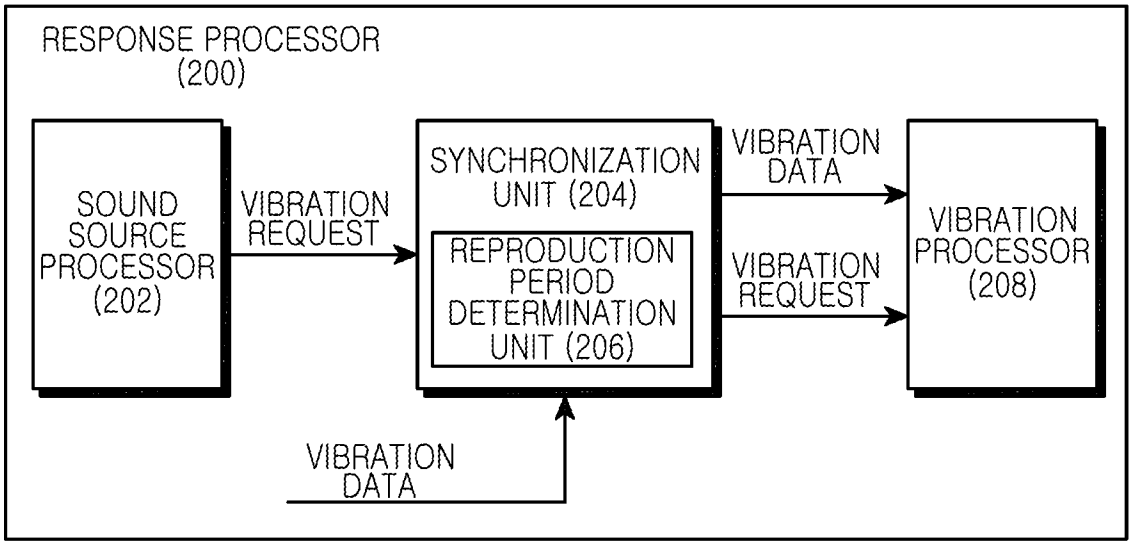
FIG. 2 is a block diagram illustrating a structure of a response processor for synchronizing a vibration and a sound source to implement a haptic function according to an exemplary embodiment of the present invention.

FIG. 2 is a block diagram illustrating a structure of a response processor for synchronizing a vibration and a sound source to implement a haptic function according to an exemplary embodiment of the present invention.

Referring to FIG. 2, a response processor 200 includes a sound source processor 202, a synchronization unit 204, and a vibration processor 208. The synchronization unit 204 may further include a reproduction period determination unit 206.

Upon detection of a touch input of a user of the portable terminal, the response processor 200 calls a vibration function. Thereafter, the response processor 200 decodes vibration data into a Pulse Width Modulation (PWM) signal and provides the PWM signal to the synchronization unit 204. According to the user's touch input, the sound source processor 202 of the response processor 200 calls a sound source function. Thereafter, the sound source processor 202 reproduces a sound source as an output by using sound source data, and then generates a vibration generation request.

In this case, the sound source processor 202 may generate the vibration generation request in a period of starting sound source reproduction or in a period of ending sound source reproduction and then directly provide the vibration generation request to the vibration processor 208. When the vibration generation request is generated in the period of starting sound source reproduction or in the period of ending sound source reproduction, it is possible to solve a problem in which the sound source and the vibration are not simultaneously generated in the portable terminal of the related art.

Further, the sound source processor 202 may reproduce the sound source as an output and thereafter provide the synchronization unit 204 with the vibration generation request irrespective of the reproduction period. Thus, the sound source processor 202 may allow the synchronization unit 204 to deliver the vibration generation request to the vibration processor 208 in the period of starting sound source reproduction or in the period of ending sound source reproduction.

Upon reception of the PWM signal including the vibration data and the vibration generation request from the sound source processor 202, the synchronization unit 204 of the response processor 200 allows the reproduction period determination unit 206 to determine the reproduction period of the sound source reproduced by the sound source processor 202.

In this case, if the reproduction period determination unit 206 determines that the reproduction period is the period of starting sound source reproduction or the period of ending sound source reproduction, the synchronization unit 204 provides the vibration processor 208 with the vibration generation request so that the sound source and the vibration may be simultaneously generated. In addition, the synchronization unit 204 reproduces the sound source to synchronize the vibration generation request to the sound source reproduction, and thereafter generates a vibration request signal according to a presence/absence of the vibration request signal.

Upon reception of the vibration generation request from the sound source processor 202, the reproduction period determination unit 206 of the synchronization unit 204 determines the reproduction period of the sound source reproduced by the sound source processor 202.

This is to mitigate a case where the sound source and the vibration are out of synchronization when the vibration generation request is generated in the middle of a period in which the sound source is reproduced.

The vibration processor 208 may include a vibration motor. When the PWM signal including the vibration data and the vibration generation request are received from the synchronization unit 204, the vibration processor 208 drives the vibration motor to generate the vibration.

That is, in an exemplary implementation, the vibration processor 208 drives the vibration motor by using the vibration request signal synchronized to the sound source reproduction by the synchronization unit 204.

If the vibration generation request is directly received from the sound source processor 202, the vibration processor 208 recognizes that the received vibration generation request is generated in the period of starting sound source reproduction or in the period of ending sound source reproduction, and drives the vibration motor to generate the vibration.

Figure 3:
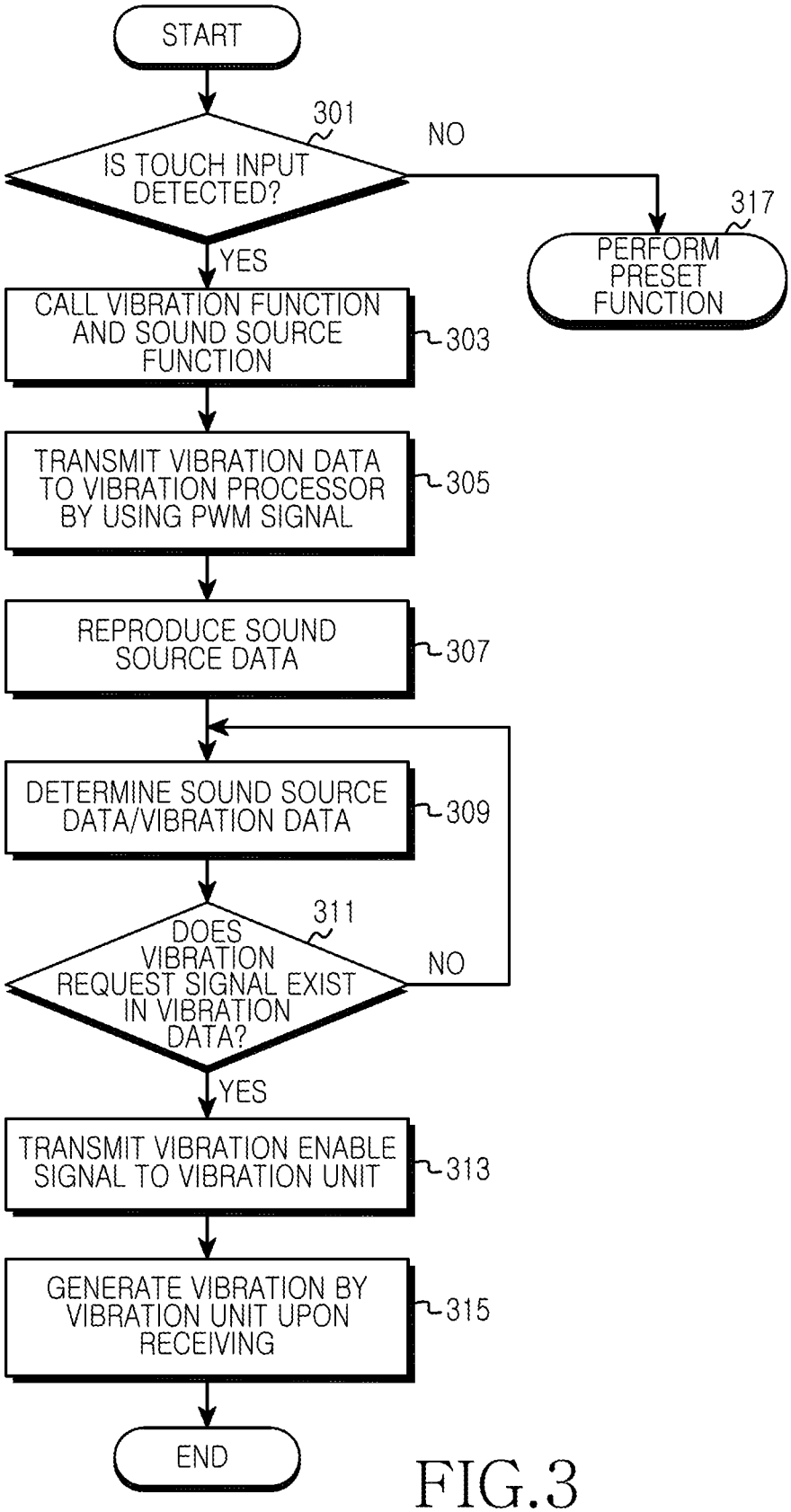
FIG. 3 is a flowchart illustrating a process of synchronizing a vibration and a sound source to implement a haptic function in a portable terminal according to an exemplary embodiment of the present invention.

FIG. 3 is a flowchart illustrating a process of synchronizing a vibration and a sound source to implement a haptic function in a portable terminal according to an exemplary embodiment of the present invention.

Referring to FIG. 3, in step 301, the portable terminal determines whether a user's touch input is detected.

If it is determined that the touch input is not detected in step 301, the portable terminal performs a preset function (e.g., a standby mode) in step 317.

Otherwise, if it is determined that the touch input is detected in step 301, the portable terminal calls a vibration function and a sound source function in step 303. The vibration function and the sound source function are functions for outputting sound source data and vibration data corresponding to the user's touch input.

In step 305, the portable terminal decodes the vibration data by using the called vibration function, and thereafter provides the decoded data to a vibration processor by using a PWM signal.

In step 307, the portable terminal reproduces the sound source data by using the called sound source function. In step 309, the portable terminal determines the sound source data and the vibration data.

In step 311, the portable terminal determines whether a vibration request signal exists in the vibration data.

The vibration data is different from typical vibration data in that it is vibration data for the haptic function. The vibration data is used to repeat vibration generation with a short time interval even at a moment in which a short touch input is made. In addition, the vibration request signal is a signal for vibration generation and exists in the vibration data.

If it is determined in step 311 that the vibration request signal does not exist in the vibration data, the portable determine repeats the process of determining the sound source data and the vibration data in step 309.

Otherwise, if it is determined in step 311 that the vibration request signal exists in the vibration data, the portable terminal transmits the vibration request signal, i.e., an enable signal for driving a vibration unit, to the vibration processor in step 313.

In step 315, the portable terminal allows the vibration processor, which receives the vibration request signal and the PWM signal, to generate a vibration.

That is, in order to address a problem in which the vibration generated by the vibration processor is out of synchronization with the sound source, the portable terminal reproduces the sound source and thereafter generates the vibration according to a presence/absence of the vibration request signal.

Thereafter, the procedure ends.

In the process of FIG. 3, a sound source processor transmits the vibration generation request to the vibration processor in the period of starting sound source reproduction or in the period of ending sound source reproduction.

Figure 4:
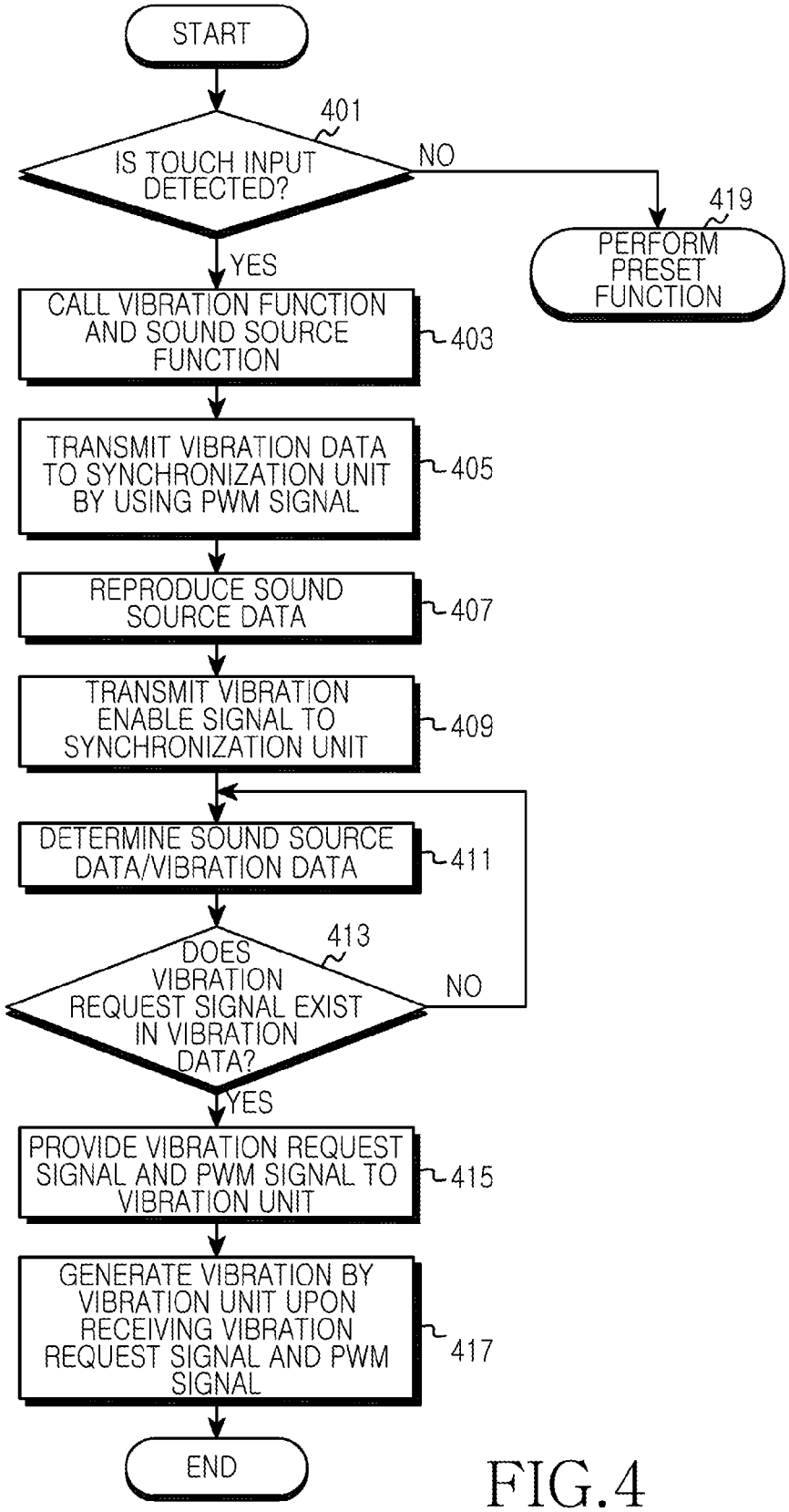
FIG. 4 is a flowchart illustrating a process of synchronizing a vibration and a sound source to implement a haptic function in a portable terminal according to an exemplary embodiment of the present invention.

FIG. 4 is a flowchart illustrating a process of synchronizing a vibration and a sound source to implement a haptic function in a portable terminal according to an exemplary embodiment of the present invention.

Referring to FIG. 4, the portable terminal determines whether a user's touch input is detected in step 401.

If it is determined that the touch input is not detected in step 401, the portable terminal performs a preset function (e.g., a standby mode) in step 419.

Otherwise, if it is determined that the touch input is detected in step 401, the portable terminal calls a vibration function and a sound source function in step 403. As described above, the vibration function and the sound source function are functions for outputting sound source data and vibration data corresponding to the user's touch input.

In step 405, the portable terminal decodes the vibration data by using the called vibration function, and thereafter provides the decoded data to a synchronization unit by using a PWM signal.

In step 407, the portable terminal reproduces the sound source data by using the called sound source function. In step 409, the portable terminal transmits an enable signal, i.e., a vibration request signal, to the synchronization unit.

In step 411, the portable terminal determines the sound source data and the vibration data.

In step 413, the portable terminal determines whether a vibration request signal exists in the vibration data.

As described above, the vibration data is different from typical vibration data in that it is vibration data for the haptic function. The vibration data is used to repeat vibration generation with a short time interval even at a moment in which a short touch input is made. In addition, the vibration request signal is a signal for vibration generation and exists in the vibration data.

If it is determined in step 413 that the vibration request signal does not exist in the vibration data, the portable terminal repeats the process of determining the sound source data and the vibration data in step 411.

Otherwise, if it is determined in step 413 that the vibration request signal exists in the vibration data, the portable terminal transmits the vibration request signal, i.e., an enable signal for driving a vibration unit, to the vibration processor in step 415.

In step 417, the portable terminal allows the vibration processor, which receives the vibration request signal and the PWM signal, to generate a vibration.

Thereafter, the procedure ends.

In the process of FIG. 4, the synchronization unit receives the vibration generation request irrespective of the sound source reproduction period, and thereafter a sound source processor transmits the vibration generation request to the vibration processor in the period of starting sound source reproduction or in the period of ending sound source reproduction.

According to exemplary embodiments of the present invention, a sound source and a vibration are generated simultaneously when a haptic function is implemented in a portable terminal. Since a vibration request signal is generated in a period of starting sound source reproduction or in a period of ending sound source reproduction, it is possible to solve a problem in which the vibration and the sound source are generated with a time difference when performing the haptic function in the portable terminal of the related art.

While the invention has been shown and described with reference to certain exemplary embodiments thereof, it will be understood by those skilled in the art that various changes in form and details may be made therein without departing from the spirit and scope of the invention as defined by the appended claims and their equivalents.

What is claimed is:

1. An apparatus for providing a haptic function in a portable terminal, the apparatus comprising:

a response processor for synchronizing a time when a vibration is generated and a time when a sound source is generated by regulating a time when a vibration request signal is generated, wherein the sound source is generated in response to a touch input, and wherein the response processor determines the time when the vibration request signal is generated by using a period in which sound source data is reproduced when the touch input is made, and generates the vibration request signal at the determined time.

2. The apparatus of claim 1, wherein the response processor determines a period in which the vibration request signal exists in vibration data.

3. The apparatus of claim 1, wherein the response processor determines the time when the vibration request signal is generated by determining at least one of a period of starting sound source data reproduction and a period of ending sound source data reproduction.

4. The apparatus of claim 1, wherein, if the vibration request signal is generated irrespective of the time when the sound source is generated, the response processor provides the vibration request signal to a vibration processor in at least one of a period of starting sound source data reproduction and a period of ending sound source data reproduction.

5. The apparatus of claim 1, wherein the response processor calls a vibration function, decodes vibration data into a Pulse Width Modulation (PWM) signal and provides the PWM signal to a synchronization unit of the response processor.

6. A method for providing a haptic function in a portable terminal, the method comprising:

synchronizing a time when a vibration is generated and a time when a sound source is generated by regulating a time when a vibration request signal is generated, wherein the sound source is generated in response to a touch input, and wherein the synchronizing of the time when the vibration is generated and the time when the sound source is generated comprises:

determining the time when the vibration request signal is generated by using a period in which sound source data is reproduced when a touch input is made; and generating the vibration request signal at the determined time.

7. The method of claim 6, wherein the determining of the time when the vibration request signal is generated comprises a process of determining a period in which the vibration request signal exists in vibration data.

8. The method of claim 6, wherein the time when the vibration request signal is generated comprises at least one of a period of starting sound source data reproduction and a period of ending sound source data reproduction.

9. The method of claim 6, further comprising, if the vibration request signal is generated irrespective of the time when the sound source is generated, providing the vibration request signal to a vibration processor in at least one of a period of starting sound source data reproduction and a period of ending sound source data reproduction.

10. The method of claim 9, wherein the vibration processor is provided decoded vibration data by using a Pulse Width Modulation (PWM) signal.

11. An apparatus for providing a haptic function in a portable terminal, the apparatus comprising:

a sound source processor for calling a sound source function upon generation of a user's touch input and for generating a vibration request signal;

a synchronization unit for synchronizing a time when a sound source is reproduced and a time when the vibration request signal is generated;

a reproduction period determination unit for determining a period in which the sound source is reproduced; and a vibration processor for driving a vibration motor upon reception of the vibration request signal.

12. The apparatus of claim 11, wherein the sound source processor generates the vibration request signal and provides the generated signal to the vibration processor in at least one of a period of starting sound source data reproduction and a period of ending sound source data reproduction.

13. The apparatus of claim 11, wherein the sound source processor generates the vibration request signal and provides the generated signal to the synchronization unit in the middle of a period in which the sound source data is reproduced.

14. The apparatus of claim 13, wherein, if the vibration request signal is provided from the sound source processor, the synchronization unit determines the period in which the sound source data is reproduced, and provides the vibration processor with the vibration request signal provided at least one of a start time and end time of the period of the sound source data.

15. The apparatus of claim 14, wherein the synchronization unit is provided decoded vibration data by using a Pulse Width Modulation (PWM) signal.

* * * * *